US008459648B2

(12) United States Patent
Kimbrough

(10) Patent No.: US 8,459,648 B2
(45) Date of Patent: Jun. 11, 2013

(54) GAME FOR TEACHING FUNDAMENTAL FINANCIAL SKILLS AND RESPONSIBILITY

(76) Inventor: Lottie Kimbrough, Saulsbury, TN (US)

( * ) Notice: Subject to any disclaimer, the term of this patent is extended or adjusted under 35 U.S.C. 154(b) by 0 days.

(21) Appl. No.: 12/723,810

(22) Filed: Mar. 15, 2010

(65) Prior Publication Data

US 2011/0221132 A1 Sep. 15, 2011

(51) Int. Cl.
*A63F 3/00* (2006.01)

(52) U.S. Cl.
USPC ..... 273/256; 434/128

(58) Field of Classification Search
USPC ..... 273/256, 278; 434/107, 109, 128
See application file for complete search history.

(56) References Cited

U.S. PATENT DOCUMENTS 4,431,195 A * 2/1984 Brand et al. ..... 273/256
5,342,056 A * 8/1994 Ajaji ..... 273/237
7,287,753 B1 * 10/2007 Brigidi ..... 273/256

* cited by examiner

*Primary Examiner* — Vishu K. Mendiratta
(74) *Attorney, Agent, or Firm* — Wayne Edward Ramage; Baker Donelson

(57) ABSTRACT

A game for teaching financial skill and responsibility to a plurality of players. Each player initially is given a predetermined amount of spending capital representing earned income and credit available, with the object to generate debt. Players move pieces around a board, incurring debt by making mandatory payments or purchasing items and pursuing opportunities based upon the spaces landed upon. A player that has accumulated the most debt may proceed to answer a change question presented by one or more financial advisors in an attempt to win the game.

8 Claims, 7 Drawing Sheets

GAME FOR TEACHING FUNDAMENTAL FINANCIAL SKILLS AND RESPONSIBILITY

FIELD

The present invention relates to a game. More specifically, the present invention relates to a game for teaching financial skill and responsibility to players wherein each player is initially given a predetermined amount of spending capital representing earned income and credit available.

BACKGROUND

A country's economic strength is dependent on the spending habits of its citizens. The ability to purchase items is an American pastime and a lifestyle that is part of the American culture. Making wise spending decisions is essential to a citizen's ability to take care of the basic needs of his or her family even when the economy declines. Many people have irrational spending habits which may unavoidably lead to an individual's need for a payout, and collectively lead to the decline of a country's economy and the need for a bailout of businesses. Some individuals who may not have the financial ability to make purchases (due to lack of earned income and cash on hand, for example) do not slow down spending if credit is available. For many individuals, available credit is easy to obtain, but the lack of self control combined with serious purchasing power may become a problem when it is time to pay off debt. The more an individual has access to obtain credit, the more likely he is to generate debt. Debt by credit is compounded by high interest increasing the original debt incurred making it more difficult to pay off such debt.

Unwise spending habits practiced by an individual while he or she is employed do not easily convert to wise spending habits when unemployment is sudden and the job market is fragile. Individuals view wise and unwise spending differently. Some individuals find it difficult even when they are unemployed to differentiate their needs from their wants.

With various means of purchasing power, it can become difficult for an individual to distinguish between wise and unwise spending. This transition becomes even more difficult to make when many individuals purchase name brand items instead of generic items. Generic items often are more likely to provide for the essential needs of families, and, in some instances, provide the same effect as name brand at less cost. This desire to purchase name brand may take on the form of "keeping-up-with the-Jones" cliché.

The desire for individuals to spend is driven by businesses that constantly push their products and services in a competitive free market. Sellers constantly market products as new and improved, efficient and more user friendly, modernized and environmentally safe, durable and long lasting. With such catch-phrases, it can become difficult for consumers to ignore products that are incessantly publicized. Businesses advertise their products and services in the traditional form of billboards, television and radio announcements, and magazines and newspapers. In addition, computer technology, smart phones, I-Pods, online advertising, Kiosk and other aggressive marketing techniques on the cutting edge inundate consumers with product awareness. As a result, the yearning to buy can be difficult to bring to an end.

The desire to spend can be never-ending when an individual is employed. However, when that same individual becomes unemployed, the ability to distinguish between wise and unwise spending can be difficult. Unwise spending is an indicator that a person is unable or unwilling to differentiate between his needs or wants, and more than likely leads to financial hardship. Likewise, the ability to save becomes secondary at best. When an individual or family transitions from employment to unemployment in a distressed economy, their need to spend for items related to family, housing, health, transportation, investment, and entertainment still exists but it is imperative that such an individual or family practice wise spending habits.

Unless pricing is extreme, environment and location play the primary roles in how individuals select which items to purchase. Buying comfort items is a double-edged sword embedded in the mindset of the American dream, and is a difficult habit to break. The fact that consumers must transition from purchasing items of wants to items of necessity may be seen as a blemish on the American dream. Even when unemployment is high, and employment at a low, limiting the desire to spend to only basic needs such as food, shelter, and clothing, is difficult.

SUMMARY OF THE INVENTION

In one exemplary embodiment, the present invention comprises a game for teaching financial skill and responsibility to both players and those viewing the game. Each player participating in the game initially is given a predetermined amount of spending capital representing earned income and credit available. One object of the game is for each player to spend capital quickly and wisely, accumulating the most debt in the shortest timeframe. The player then becomes eligible to go before at least one financial advisor or a financial advisory board for an opportunity to receive a financial payout. Another object of the game is for a player to generate wise debt, such that would rejuvenate the economy. Still another object of the game is to have an open dialogue discussing reasons why some people have wise spending habits while others have unwise spending habits and to learn about wise spending from such discussion.

In one embodiment, the game components comprise spending capital on hand, including cash, available debit and available credit. The game additionally includes a first set of game events for determining how the players will proceed in turn. A second set of game events potentially affect the spending capital of a player, and include opportunities to acquire income or acquire debt with spending capital. The game further includes a third set of game events that potentially affect which player, if any, will become eligible to go before at least one financial advisor or financial advisory board to potentially win the game. This may be triggered by a player acquiring more debt than other competing players, or a player answering a change question. In one embodiment, the player who wins the game receives a monetary prize.

In one embodiment, the game is a board game, where spending capital on hand comprises play money script. The available debit on hand comprises a play debit card, and the available credit on hand comprises a play credit card. The players roll dice and proceed along a game board divided into a plurality of categories, with each category having a plurality of coordinating opportunity cards and plurality of slots. In one embodiment, the plurality of slots include category slots and action slots. The plurality of opportunities to acquire income or acquire debt with spending capital include opportunity cards and mandatory payments. In other embodiments, the game may be played on a computer, video gaming system, hand held computing device, cellular phone, or the like.

In yet another embodiment, the present invention comprises a method of teaching financial skill and responsibility to players by having the players participate in a game as described above.

DETAILED DESCRIPTION OF EXEMPLARY EMBODIMENTS

Figure 1:
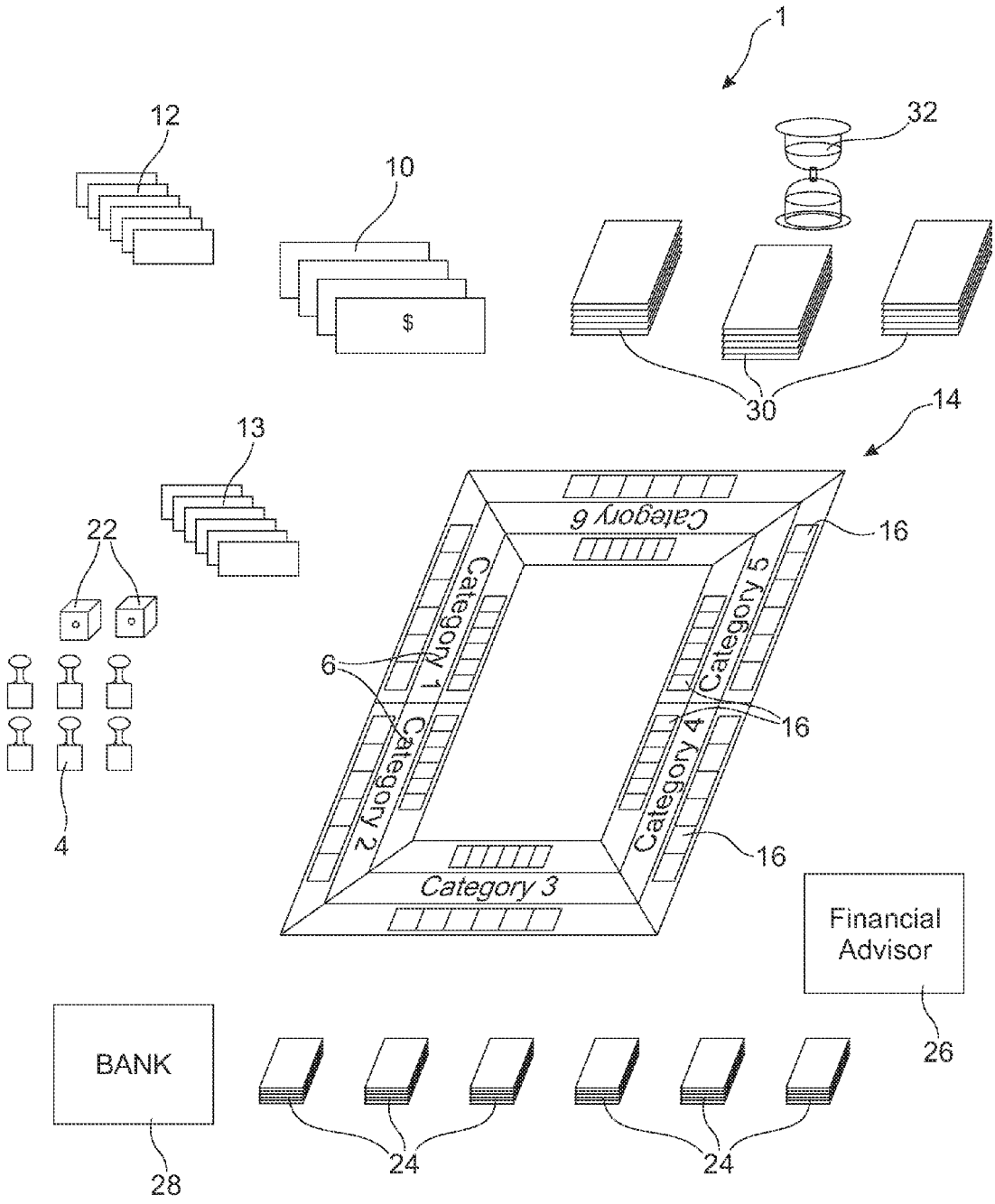
FIG. 1 is a schematic view of a game with a rectangular board or playing area in accordance with one exemplary embodiment of the present invention.

In one exemplary embodiment, as shown in FIGS. 1-6, the present invention comprises a game 1 for teaching financial skill and responsibility. A plurality of players may participate in the game, although in variants of the game a single player may participate. A player is defined as a participant in the game, including an individual (playing in person or through a computer), or a computer-generated or computer-run participant. There may be any number of players; in one exemplary embodiment, six or twelve players participate in the game.

It should be noted that the game may be presented in several embodiments. While the discussion below describes the game primarily in the context of a board, the game also may be presented in the form of a television game show, a computer game, an on-line computer game, a video (e.g., Wii, Xbox, or Playstation) game, or the like.

Initially, each player is assigned or selects a playing piece (or "traveler") 4. The piece represents the player as he or she moves around the board or playing area 14. In one embodiment, the traveler pieces 4 may each comprise different colors. Alternatively, the pieces may comprise different shapes, sizes, figures, objects, or the like. As discussed below, in one embodiment, the selection of the playing piece corresponds to the selection of a category 6. In one embodiment of the game, one player is assigned to each category. In another embodiment, two or more players may be assigned to each category. Where multiple players may be assigned to a category, a combination of color with different shapes, sizes, figures or objects for the traveler pieces 4 may be used to distinguish the pieces.

In general, the game board 14 comprises a plurality of categories 6. Each category has a plurality of opportunity cards 24 associated with that category. In one embodiment, each category also is associated with at least one traveler piece 4. A certain color also may be associated with each category, with the same color being used for the corresponding opportunity cards 24 and traveler piece(s) 4.

Figure 2:
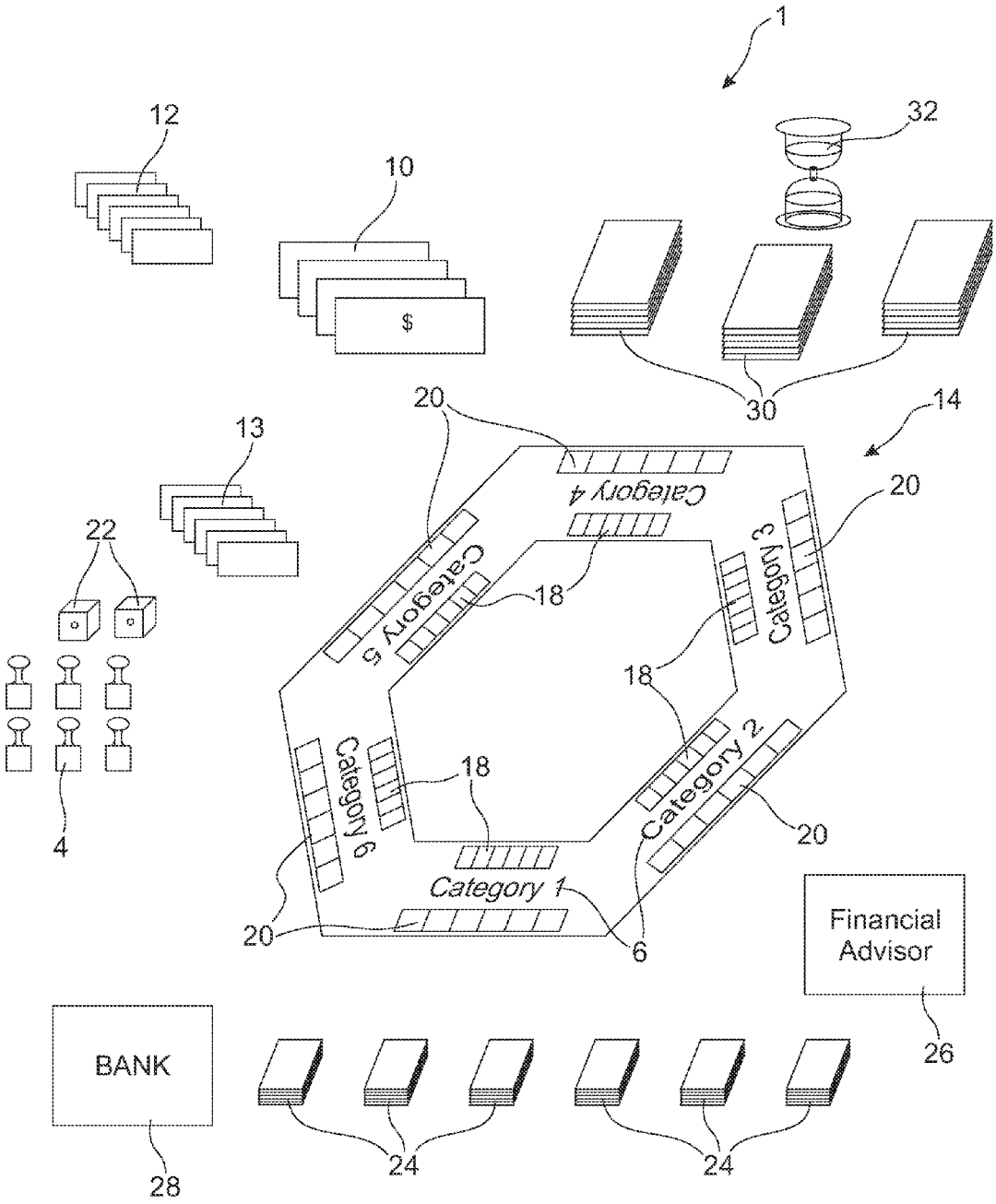
FIG. 2 is a schematic view of a game with a hexagonal board or playing area in accordance with another exemplary embodiment of the present invention.

Any number of categories and opportunity cards may be used as desired. In one embodiment, as shown in FIG. 1, the game has six categories 6, six traveler pieces 4 (one per category), and thirty opportunity cards 24 per category. The categories are laid out in sequence on the board, with each category comprising a side (or part of the side) of the board 14. The board may be of any suitable shape, including rectangular, square, hexagonal (as shown in FIG. 2), circular, polygonal, or the like.

Figure 3:
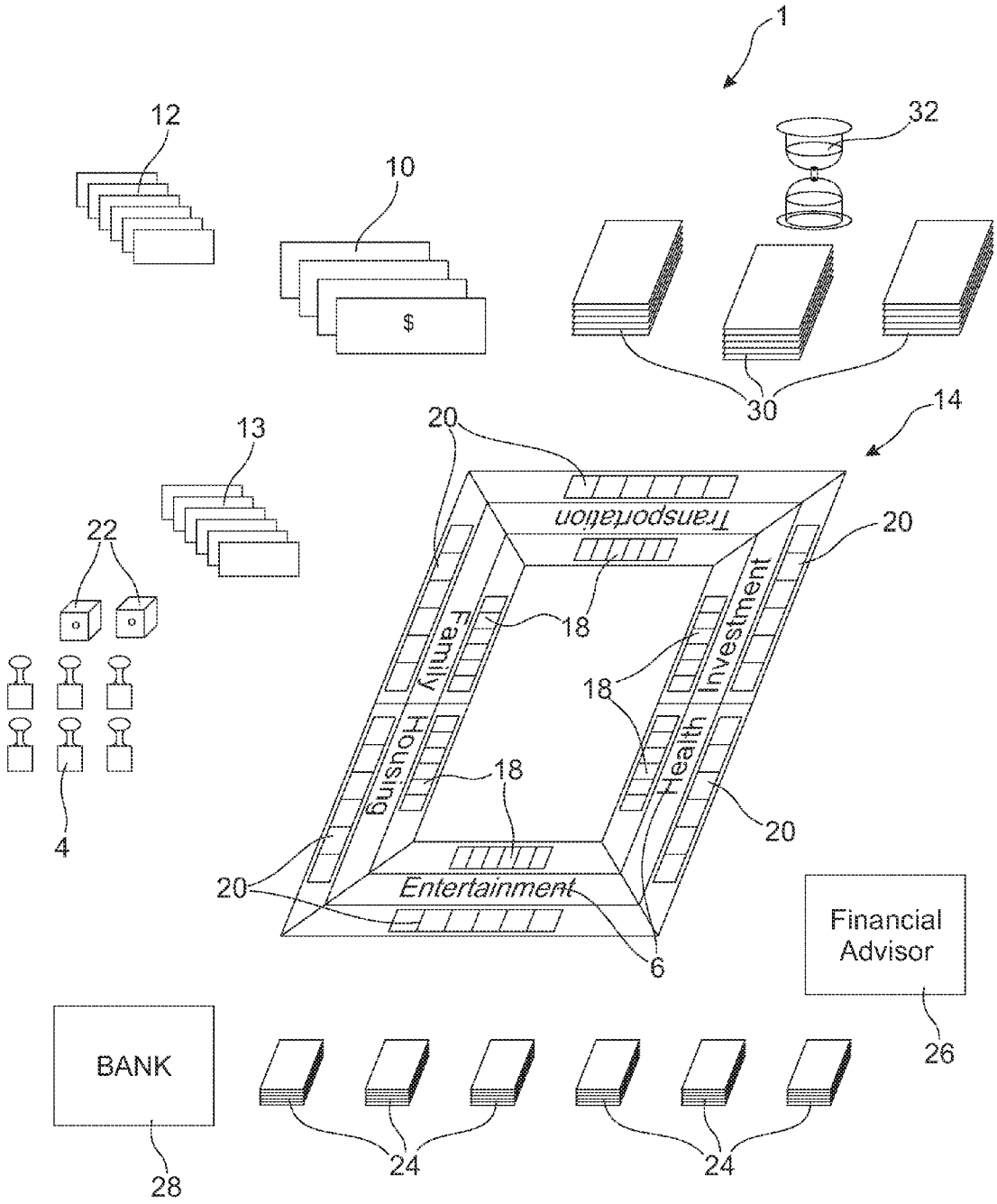
FIG. 3 is a schematic view of the game of FIG. 1 with specified categories.
Figure 4:
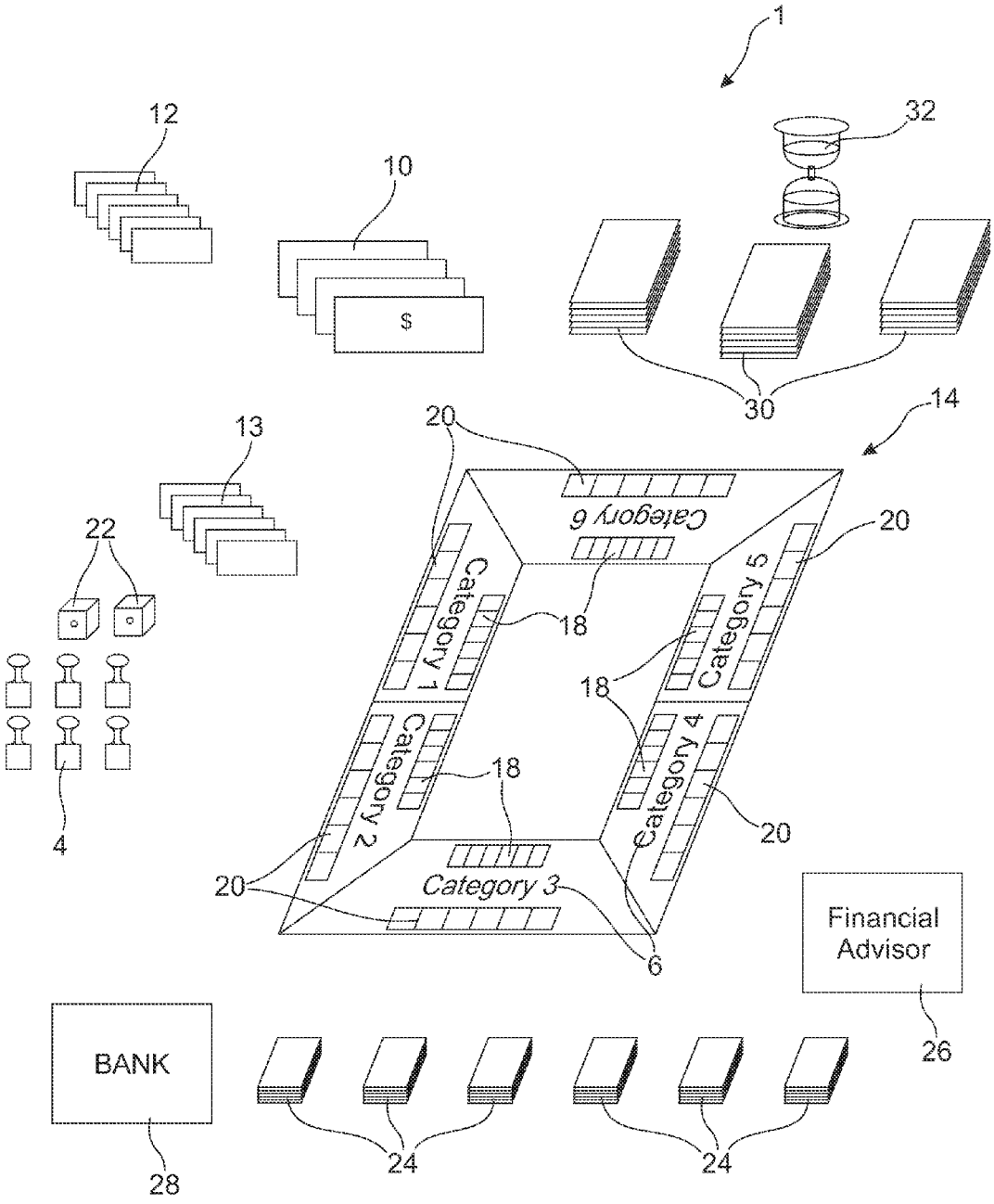
FIG. 4 is a schematic view of the game of FIG. 1 with an alternative board arrangement.
Figure 5:
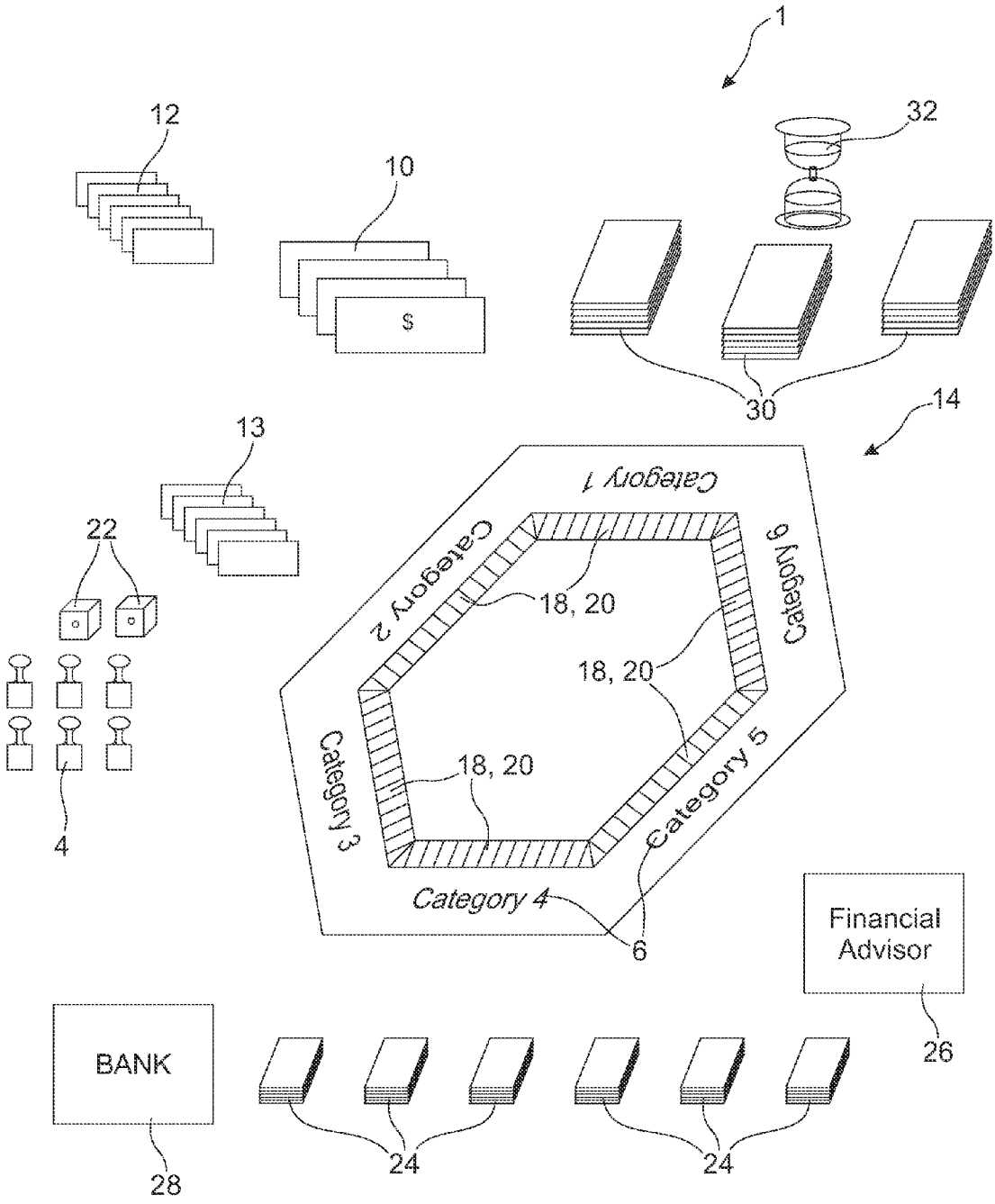
FIG. 5 is a schematic view of the game of FIG. 2 with an alternative board arrangement.
Figure 6:
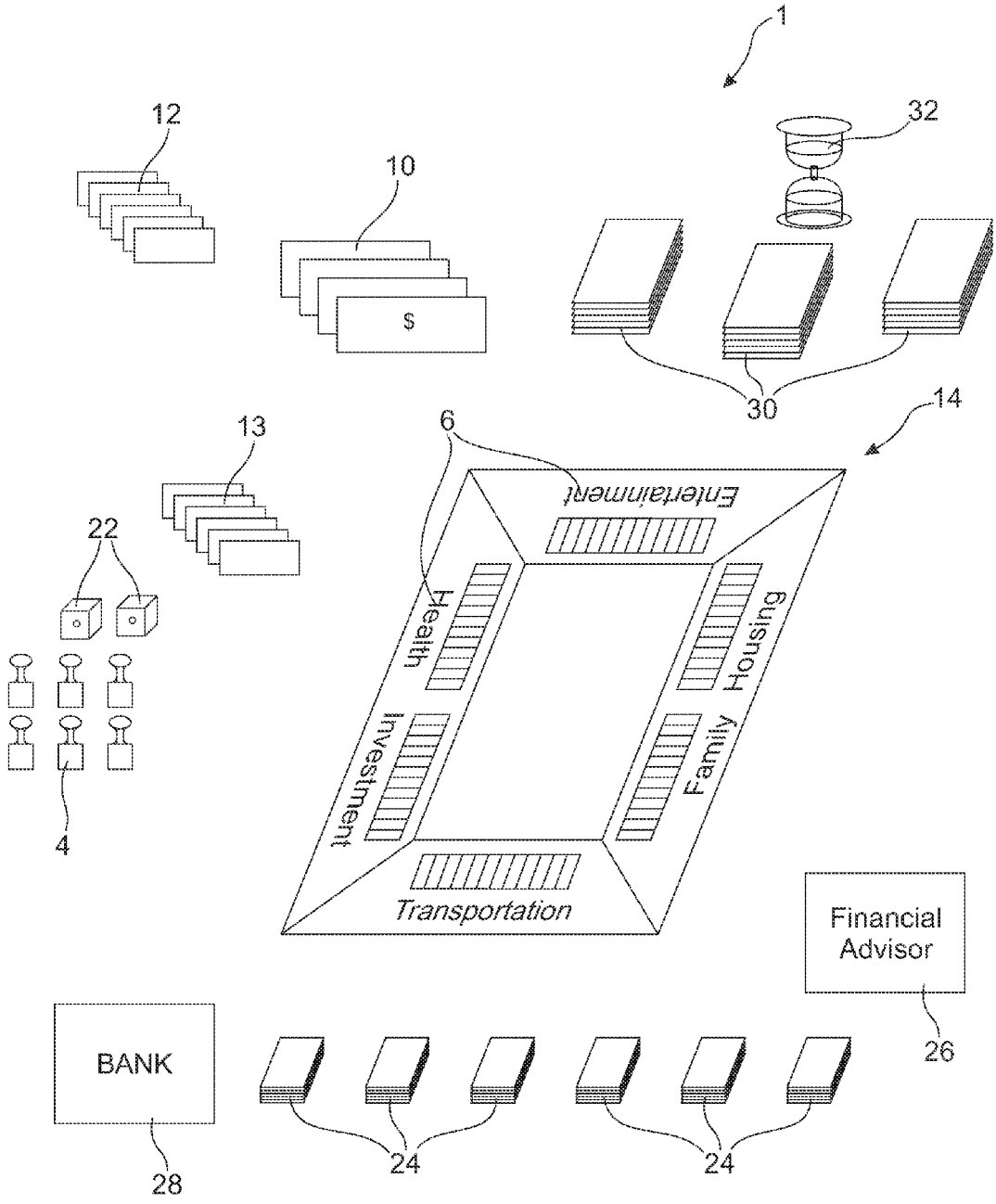
FIG. 6 is a schematic view of the game of FIG. 3 with an alternative board arrangement.

In the embodiment shown in FIG. 3, the board has been marked with six established category subject matters: family; housing; health; transportation; investment; and entertainment. Other subject matters may be employed as desired in alternative versions of the game.

Players may be assigned to a particular category (e.g., family, housing, health, transportation, investment or entertainment) at random or by player choice. Alternatively, category assignment may be more directed, based upon the player's demonstrated spending habits.

In various embodiments, each category utilizes a plurality of slots or spaces 16 for players to move their pieces 4 on the board 14. Slots 16 include category slots 18 and action slots 20. There may be an equal number of category slots 18 for each category. There also may be an equal number of action slots 20 for each category. In the embodiment shown in FIG. 4, for example, there are six category slots 18 for each of the six categories (e.g., family, housing, health, transportation, investment, and entertainment), and six action slots 20 for each category. The category slots 18 may be placed in a row above the action slots 20 for each category (see FIG. 4), below the action slots, or in a row with the action slots (see FIGS. 5, 6). In the latter configuration, the category slots may alternate with action slots. In one embodiment, all of the action slots and category slots associated with a category may be located on the board in the same category area. Alternatively, some portion of the action slots or category slots associated with a category may be distributed among other category areas.

In one embodiment, each action slot in a category corresponds to a specific subject matter. For example, each set of action slots comprises one home action slot, one rent/mortgage action slot, one savings action slot, one risky spending slot, one sacrifice action slot, and one going green action slot.

The total number of slots 16 may vary as desired by one of skill in the art. Additionally, the total number of action slots 20 and/or category slots 18 may vary. In one embodiment, slots 16 may comprise only category slots 18.

After the selection of categories and playing pieces, each player then is given a predetermined amount of spending capital with which to play the game 35, with an object for each player to generate debt. Spending capital may represent earned income or credit available, or both. In one embodiment, spending capital includes cash 10, available debit 12, available credit 13, or a combination thereof. In an embodiment of the present invention as a board game, the cash is play money script 10, the available debit on hand is one or more play debit cards 12, and the available credit on hand is one or more play credit cards 13.

The predetermined initial amount of spending capital may vary as desired, along with the breakdown between cash, debit and credit. In one embodiment of the game, each player initially receives a total of $10,000 in spending capital, as follows: $1,500.00 in cash (e.g., play money script), $3,500 in available debit (e.g., play debit card), and $5,000 in available credit (e.g., play credit card). Items purchased with the debit 12 and/or credit card 13 may be marked up by a certain percentage (e.g., 3%, 5%, 10%, 20%, or some other amount). In general, each player should receive the same initial amount of spending capital, although in various embodiments the amount of initial spending capital may vary among players. There also may be a variance between players in the breakdown between cash, debit and credit.

Figure 7:
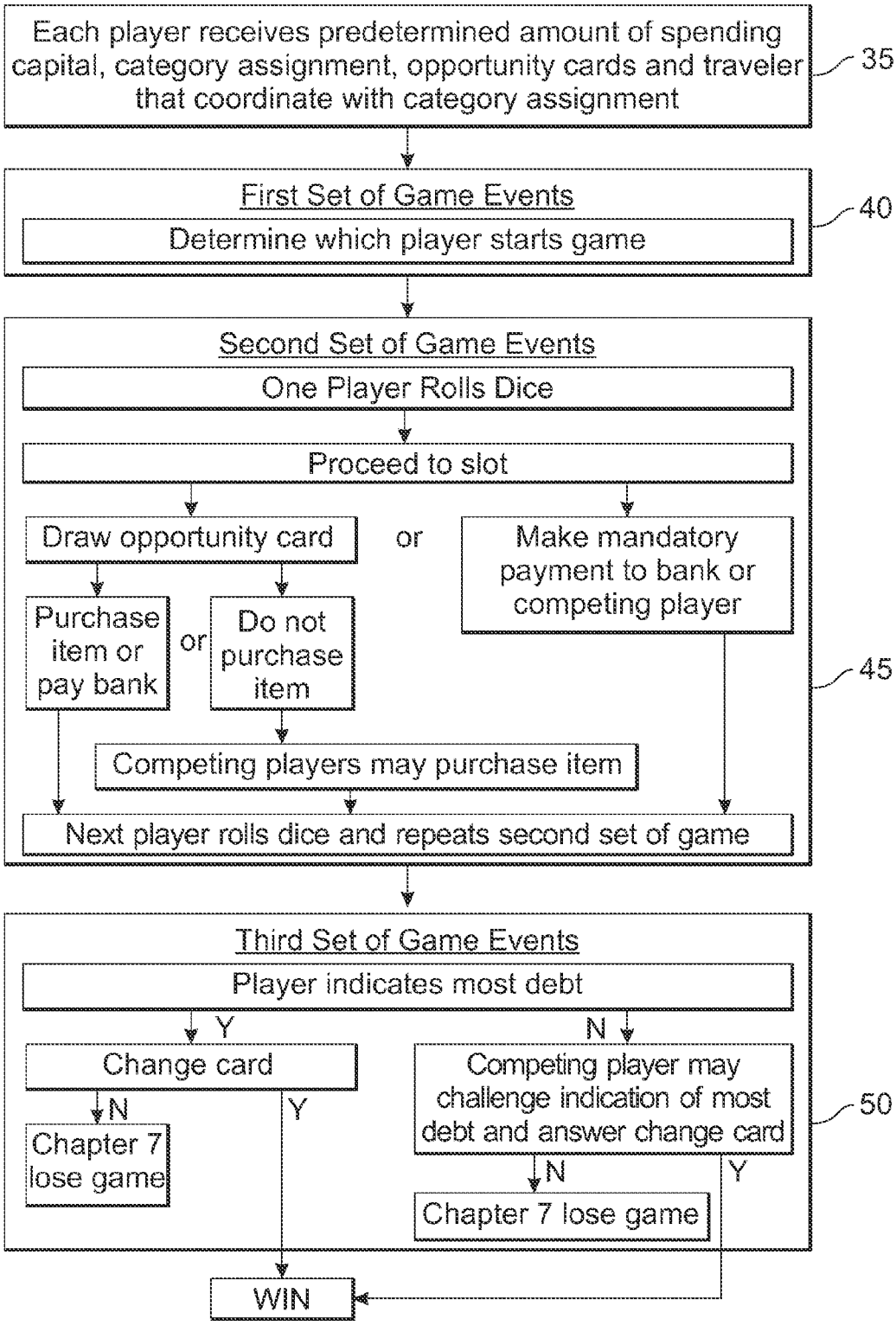
FIG. 7 is a flow chart of the events which occur in a game in accordance with an exemplary embodiment of the present invention.

As seen in FIG. 7, the next step is determining the order of turn. This can be accomplished in a variety of ways. The players may agree upon an order of turn. Alternatively, each player rolls one or two dice 22. In one embodiment, the player who rolls the lowest number on at least one die, or both dice in combination, starts the game. In another embodiment, the player who rolls the highest number on at least one die, or both dice in combination, starts the game. In computer-based versions of the game, a random number generator may be used to determine order of turn automatically. Other methods of determining order of turn as known in the art may be used as desired.

After determining the order of turn, play starts. In general, each player takes his or her turn throwing the dice 22 and moving his or her traveler piece 4 the number indicated by the dice 22 along the game board 14. As the game proceeds, players are presented with a plurality of game events 45 that potentially affect their spending capital. This set of game events includes a plurality of opportunities for players to acquire income or debt with their spending capital. These opportunities are governed by the category slots 18 and action slots 20 the player lands on, which may require mandatory payments to or from the player.

In one embodiment, each player starts the game from his or her respective category's home action slot. Alternatively, each player starts at a starting base. The starting player rolls the dice 22 and moves his or her traveler piece 4 along the board 14 according to the number indicated by the roll of the dice, thereby landing on a category or action slot. After the starting player, the game proceeds in a clockwise or counter clockwise direction with each player rolling the dice and moving his or her traveler piece to a particular category slot or action slot based on the dice roll. The action taken by the player depends on the slot landed upon.

When a player's traveler stops on an action slot 20 (e.g., home, restitution, risky spending, sacrifice, or going green) that requires mandatory compliance, the player must comply with the direction indicated on such slot or the player is eliminated. For example, if a contestant stops on a competitor's home slot, he or she must pay a mandatory fee (such as $700) to the competitor. If a contestant stops on a competitor's restitution slot, he or she must pay a mandatory fee (such as $400) to the competitor. If a contestant stops on a competitor's risky spending slot, he or she must pay a mandatory fee (such as $300) to the competitor player. If a contestant stops on a competitor's sacrifice slot, he or she must pay a mandatory fee (such as $1000) to the competitor. If a contestant stops on a competitor's going green slot, he or she must pay a mandatory fee (such as $600) to the competitor. In one embodiment, each action slot 20 requires a mandatory payment from or to a player. The mandatory payment may be made to a bank 28. The amount of all mandatory fees may vary as desired by one of skill in the art and will be set forth in the directions of the game.

Each action slot 20 corresponding to each category 6 may have a specified description, e.g., one or more number that can be rolled on the dice. For example, such specified description may be numbers 7, 4, 8, 3, or 10 rolled on the dice or OB (indicating off-board). For example, if a player rolls a seven on the dice, the player moves his traveler piece to the home action slot. If the home action slot is his or her assigned category 6, the bank 28 pays that player a mandatory payment (e.g., $500). If the home action slot is a second player's assigned category, the active player pays the second player a mandatory payment. If the player rolls a four on the dice, the player moves his traveler piece to the rent/mortgage action slot. If the rent/mortgage action slot is his or her assigned category, that player must pay a mandatory payment to the bank 28 (e.g., $900). If the rent/mortgage action slot is a second player's assigned category color, the active player must pay the second player a mandatory payment.

Similarly, if a player lands on a savings action slot, risky spending action slot, or sacrifice action in his or her assigned category, that player must pay a mandatory payment to the bank (e.g., $300, $800, or some other amount, which may differ based on the type of slot). If the action slot landed on is a second player's assigned category, the active player must pay a mandatory payment to the second player.

Description of action slots requiring mandatory payments may vary as desired and as determined prior to beginning the game. Descriptions of the action slots and mandatory payments may be set forth in the directions for the game.

If a player rolls the dice outside of the designated board parameter (i.e., off the board), the player moves his traveler piece to the going green action slot closest to the assigned color category to where one or both dice rolled off the board. If the going green action slot is his own color, the player pays a mandatory payment to the bank. If the going green action slot is a second player's assigned category, the player must pay a mandatory payment to the second player.

Each category of the game utilizes coordinated opportunity cards 24, each card indicating one item and the price required to purchase that item. The item and price per card may be a wise or an unwise purchase. In one embodiment, each category (e.g., family, housing, health, transportation, investment, and entertainment) has thirty corresponding opportunity cards, which may include five tax cards. Each player receives corresponding color-coded opportunity cards 24 to match his or her category and traveler piece. As shown, opportunity cards are placed on the game board face down in front of each player. Alternatively, opportunity cards may be placed anywhere on or near the board. Opportunity cards are kept face down during the game.

The following table presents sample opportunity cards:

| Category 1 (Family) | Category 2 (Housing) | Category 3 (Transportation) | Category 4 (Health) | Category 5 (Investment) | Category 6 (Entertainment) |
|---|---|---|---|---|---|
| Loan Grocery Money to Niece $200 | Paint Family Room $200 | Buy Two Car Tires $200 | Buy Eye Glasses $200 | Donate to Food Pantry $400 | Buy baseball accessories for son $200 |
| Prom Dress for Daughter $500 | Add Guest Bathroom $2000 | Repair Air Conditioner in Car $600 | Join Health Club for one year $4000 | Web Page for Business $400 | Buy I phone $500 |
| Buy School Supplies | Repair Dishwasher | Restore old Car for Profit | Pay Health Insurance | Operating Tax | Broadway Show (son in |

-continued

| Category 1 (Family) | Category 2 (Housing) | Category 3 (Transportation) | Category 4 (Health) | Category 5 (Investment) | Category 6 (Entertainment) |
|---|---|---|---|---|---|
| $400 | $400 | $800 | $600 | $300 | show) & Dinner $600 |
| Pay Income Tax $900 | Pay Mother's Heating Bill $700 | Highway Tax $300 | Attend Stop Smoking Seminar $400 | Invest in McDonald's Stock $600 | Family Vacation $2500 |

When a player's traveler stops on a category slot 18, the player pulls an opportunity card 24 from its corresponding color coded category. At that time, the player decides within a designated time frame (such as 15, 20 or 30 seconds) 32, based on the description of the item set forth on one side of the opportunity card, if he or she wants to purchase the item. The price of such item is set forth on one side of the opportunity card. In one embodiment, the items indicated on the cards 24 are read aloud to the competing players. In one embodiment, each player receives at the outset of the game one opportunity (or mystery) card corresponding to the category 6 for which the player is representing wherein the details of such one opportunity (or mystery) card is not read aloud to the competing players.

If the player does not decide within the designated time frame to purchase the item, he must pay a late fee to bank 28. The late fee may be any amount previously set forth in the directions of the game. If the player decides he or she does not want to or cannot (due to lack of spending capital) purchase the item within the designated time frame 32 or if he does not make a decision within the designated time frame, a competing player has the opportunity to purchase the item described on the opportunity card 24. If none of the players purchases the item, that opportunity card may be discarded. If the opportunity card 24 drawn by a player is a tax opportunity card, such player is mandated to pay such tax to the bank 28. If the player cannot pay the allotted tax indicated on the card 24, the player is eliminated from the game.

In one embodiment, each category slot 18 that corresponds to each of the categories 6 has a specified description such as a number that can be rolled on the dice. For example, in one embodiment, numbers 2, 5, 6, 9, 11, and 12 rolled on the dice require a player to proceed to a category slot 18.

Players continue to take turns throwing dice 22, pulling opportunity cards 24, complying with a mandatory action slot 20, making purchases and moving traveler pieces 4 around the board 14 until a player believes he or she has spent wisely in accumulating debt and has accrued more debt than the competing players. A third set of game events includes a player acquiring more debt than other competing players 50. Once a player believes he or she has accumulated more debt than the competing players, the player may indicate that he or she is ready to proceed by indicating that he or she needs a financial payout or bailout. The first player to indicate his or her belief of qualifying to receive a payout or bailout has an opportunity to go before at least one financial advisor 26 who will decide if such player should receive such payout or bailout. To receive a payout or bailout, player must answer a question presented by a change card 30. In one embodiment, there are a plurality of financial advisors which represent a financial advisory board but any number of financial advisors may be used.

In one embodiment, in order for a player to proceed and receive an opportunity for a payout, a player must pay a mandatory fee (such as $100) to the bank. If a player does not have the spending capital to pay the mandatory fee, he or she loses the opportunity to go before the at least one financial advisor or the financial advisory board and is removed from game. Game resumes with the remaining players until a second player believes he or she has accumulated more debt than the other competing players. Such player then indicates his belief that he or she is entitled to a payout or bailout and has the ability to pay the mandatory fee to bank. Such second player then has the opportunity to go before at least one financial advisor who will decide based on the player's spending record throughout the course of playing the game whether the player will receive such payout or bailout.

In one exemplary embodiment, the player who proceeds in front of the at least one financial advisor 26 must sufficiently answer a question presented on a change card 30. The question will be presented to the player by the at least one financial advisor 26 before such player can win the game. In one embodiment, the player must answer the change question within a designated time frame 32 (such as 30 seconds). The change card 30 may require the player to indicate changes he or she will make in order to not need another payout or bailout in the future. The answer must satisfy at least one financial advisor in order for the player to win the game.

The question presented on a change card 30 to the player may be based on the category 6 of that player. In one embodiment, change questions are prepared by at least one financial advisor 26 at the present moment during the game. The financial advisor may write down the question to be presented. In another embodiment, the questions are written on the change card prior to the start of the game. In yet another embodiment, the questions are preprinted on the change cards 30.

The following table represents sample change card questions:

| | |
|---|---|
| Health - Name 4 things you would change to improve your health. | Daily exercise - walking<br>Eat healthier - more fruits and vegetables<br>Drink more water<br>Regular check up with physician |
| Housing - Name 4 things you would change differently regarding buying a home. | 25% down payment when buying home<br>Save money for home maintenance<br>Buy home in stable neighborhood<br>Consider buying townhouse or condominium<br>Ensure income aligns with house note<br>Pay for furniture before buying house |
| Family - What would you change regarding family habits? | Dine out less<br>3 nights quality time with family discussion<br>Use coupons when buying groceries<br>Buy clothes and other items out of season<br>Volunteer at least once a month<br>Vacation - camping trip instead of hotel |
| Investment - Explain one investment habit you would do differently. | Put at least 10% in savings each pay period<br>Invest in 401-K or IRA<br>Investment in home based small business<br>Take college courses to improve job skills<br>Invest in a solar energy project |

-continued

| | |
|---|---|
| Entertainment - What entertainment habits would you change? | Attend movies/play 5 times a year<br>Buy CD or DVD only 6 per year<br>Eliminate cable or basic cable only<br>Entertain more at home & less in clubs |

Depending on the format of the game played (whether television, computer, board, video, Wii or other), the financial advisor 26 may or may not be an actual player of the game. In one embodiment, the financial advisor is a participating player who was designated at the start of the game to be the financial advisor (another player is selected as a second financial advisor to act as the financial advisor for the first financial advisor should the latter decide to attempt to win the game). In another embodiment, the at least one financial advisor is not a participating player and is solely designated to perform the job of financial advisor. The financial advisor may offer players financial consultation during the game, including suggestions and practical advice for improving unwise spending habits and confirmation of wise spending habits.

In one embodiment, the player who wins the game by successfully acquiring the most debt and successfully answering the change card will receive a monetary payout or bailout. A monetary payout received by a player will depend on the amount of accumulated debt which resulted from wise spending, and may be determined from a range established prior to the start of the game. For example, if a player has accumulated a debt of $4,000 or more in wise spending, there is an opportunity to receive no less than $4,000, and up to $40,000 in payout. If a player has accumulated a debt of $6,000 or more in wise spending, there is an opportunity to receive no less than $6,000 and up to $60,000 in payout. If a player has accumulated a debt of $8,000 or more in wise spending, there is an opportunity to receive no less than $8,000 and up to $80,000 in payout. If a player has accumulated a debt of $10,000 or more in wise spending, there is an opportunity to receive no less than $10,000 and up to $100,000 in payout. The financial advisor or advisors will determine the exact amount of the payout.

If the player is unable to answer the change card successfully to the satisfaction of the financial advisor or advisors within the designated time frame, the player becomes ineligible for a payout and must file bankruptcy or chapter 7, and is eliminated from the game. Play proceeds with the remaining players. If no participating player is able to successfully win the game, the game ends. In versions where there is an actual monetary prize at stake and the game ends with no participating player able to successfully win the game, the monetary prize may be rolled over to another game, or may be awarded to a charity or worthy cause.

In a television game version, if the game is played before an audience, if a player fails to answer the question presented on the change card in the designated time frame and fails to receive a payout from the at least one financial advisor, the player may still be eligible to receive a bailout or payout from the audience. In one exemplary embodiment, if a player can convince one person from the television audience that he or she deserves a payout, such player is eligible to receive an audience payout or monetary prize. The audience may vote on what prize the contestant should receive, if anything.

At any time during the game, if a player has insufficient funds to play, the player is eliminated from the game.

In one embodiment, when playing a computer opponent on a computer-based game, or a computer or live opponent in an on-line version of the game, a player selects one or more categories he or she wishes to play. The player may select to play in more than one category. The more categories selected, the faster and more difficult the game is to win.

In versions with a computer opponent, if the player decides to select one category to play, the computer opponent will do likewise, selecting a category not selected by the player. The selection by the computer may be random. If the player selects two categories, the computer randomly selects two categories from the categories that were not selected by the player. If the player selects three categories, the computer selects the remaining three categories (in a version with six categories). The more categories selected by a player, the more difficult and fast paced the game is to play, with one category selected being the least difficult and three categories selected being the most difficult.

In versions with multiple players, the players may agree upon the number of categories to be selected, and the categories may be assigned randomly. Alternatively, players may click on a random number generator (which may be represented by a dice icon or the like) to determine who makes a first category selection, with alternating selections made by the players thereafter.

After categories have been selected, the player (or players) clicks on the random number generator (i.e., "roll") to determine who goes first. The number generated on this roll may be used for the first move. Alternatively, the player may have to "roll" again. The player's traveler piece is moved on the board the indicated number of spaces. If a player's traveler lands on an action slot 16, the mandatory fee is automatically deducted from or paid to the player's spending capital. Opportunity cards 24 are displayed on the screen, and a digitalized timer 32 counts down the time the player has to either purchase an item or pass before he or she is timed out. If player purchases an item, the purchase amount is deducted from player's spending capital. If timed out, a timeout fee is deducted from player's spending capital. If a player purchases an item the purchase amount is deducted from player's spending capital. Play then proceeds to the other players.

In a version with a computer player, if the computer "spenout" button lights up first (thus indicating that the computer has accumulated more debt than the player), the player loses the game. If player clicks on the "spenout button" before the computer does, player has an opportunity to win the game. A randomly selected change card 30 question is revealed, prompting player to type in change answer promptly and successfully to win the game. The answer entered by player is displayed on the computer screen. If player wins the game, applause, balloons, bells and whistles, and the dollar amount or other prize that the player has won may be displayed. The higher the winning prize, the more sounds and whistles. If player does not win (i.e., by answering incorrectly), bankruptcy icon and screen display (with appropriate sounds) appear.

In a video game version (e.g., Xbox, Nintendo Wii, Playstation, etc.) of the game, selection of categories is performed in a similar manner as described above. For example, each player selects one or more categories he or she wishes to play. In one embodiment of the video game version, the goal of the game is for family members and friends to go on a frenzy spending spree and aggressively outspend each other by buying the most items in the shortest time frame. Players are given a predetermined amount of spending capital as described above, and must out-spend other players by using the controller to read opportunity cards and purchase items wiser and faster than other players. Players pressing and/or releasing a first controller button to buy an item displayed within a designated time frame. If player does not buy an item displayed on the opportunity card, he or she may press and/or release a second controller button indicating the player wishes to pass on buying a particular item. The object of the game is to out-spend other players while making wise purchases, save enough spending capital to pay a mandatory fee ("spenout" fee) which allows a player to go before the at least one financial advisor, and press and/or release a third controller button before other players to potentially win the game. To initiate a player's turn, a player may press and/or release a fourth controller button for random number generation (e.g., dice roll) and must decide to purchase or pass quickly before the designated time frame expires and he or she is timed out. If timed out, the player's ability to purchase is blocked, and a mandatory time out fee is deducted from his spending capital. When a player makes a purchase or pays mandatory fees, such fees are deducted from his spending capital. If a player has depleted his spending capital or does not have sufficient spending capital to play, he is eliminated from game.

The first player to press and/or release the third controller button has an opportunity to win if no competing player challenges his total spending amount. Player presses and/or releases a fifth controller button to go before the at least one financial advisor. Player presses and/or releases a sixth controller button indicating the display of a change card. If player satisfactorily answers question presented on change card to the at least one financial advisor, player wins the game. Winning prize and or prize money depends on player's wise spending amount and will be predetermined before beginning game.

In another embodiment of the video version of game, each player selects one or more categories 6 he wishes to play. As cards appear for players to purchase, players use the controller (joystick) to out-spend each other by quickly and wisely buying items listed on cards. The objective of the game is to be the first player to use the controller to buy, pass, and pay mandatory fees. The ultimate objective is to spend more items wiser and faster than other players. A player can be challenged by another player if that player believes he has purchased wiser items. Player must not overspend and have sufficient money to pay bailout fee, otherwise he is out of the game. Likewise, player must be prepared to answer change questions that appear on the screen within the designated time frame and satisfactory in order to win the game.

In one embodiment, the game is presented in the form of a television game show which provides an opportunity to reach the key target audience which is the average, unemployed person who needs help identifying and addressing unwise or even irrational spending habits. The game provides an opportunity for players to receive a monetary payout. The game allows the players to share their financial situation and experiences after incurring hardships because of economic distress and their spending habits that led to a need for a payout.

Detailed rules and instructions for an exemplary embodiment of a television version of the game are as follows:

The Spenout Television Game Show is moderated by a Game Show Hostess.

There are 6 contestants (12 if couples play) who play the Spenout game.

The Spenout categories are Health, Investment, Entertainment, Family, Transportation, and Housing.

Contestants play in one of six categories based on negative economical occurrences that led to him or her making risky spending choices.

Contestants are seated on stage in front of a live television audience.

Contestants in Health, Investment and Entertainment are seated on the left. Contestants in Family, Transportation, and Housing are seated on the right.

There are six Action Slots: Home, Restitution, Savings, Risky Spending, Sacrifice, and Going Green.

Category and Action slots are recognized on the Spenout board by their Spenout colors: blue=family, purple=housing, orange=health, red=transportation, green=investment and pink=entertainment.

Stimulus Traveler (contestant moving piece) is defined by their coordinating category colors and initials. SNM=blue, MSS=purple, ALK=orange, CAT=red, IAB=green, and AEK=pink.

Contestants use their Stimulus Traveler (moving square) to move around the Spenout board based on the number thrown on the dice.

The number thrown on the dice determines where on the Spenout Board contestant's Stimulus Traveler will stop.

Each contestant starts the game from the Spenout starting base.

The contestant who throws the lowest number on the dice starts the game. The game starts from the left moving counter clockwise.

There are 30 Economic Stimulus cards, per category, that contain wise and foolish items contestants can buy. The contestant whose turn it is to pull an economic stimulus card has ten seconds to purchase the item, otherwise the contestant forfeits his or her turn and must pay a $250.00 Not On Time Fee. The opportunity to buy is passed to contestant (counter clockwise). If no one buys the card it is discarded from the game.

There are three Financial Advisors (Liberal, Independent, and Conservative) who track contestants wise or foolish spending, and ultimately vote for or against a contestant to receive a prize or cash payout.

Mixed in with the 30 opportunity cards are 5 Tax cards. When a contestant pulls a Tax card, he must pay the amount on the card to the Spenout Bank.

Contestants receive 1 Spenout Mystery Card in his/her category face down. This card is not to be placed in the contestant's hand until each player has moved their Stimulus Traveler around the Spenout Board at least once.

Each category contains one blank Stimulus Spenout Super Card. When a contestant pulls this card, the contestant has an opportunity to write his opportunity card. This must be accomplished within ten seconds otherwise the contestant forfeits his turn, and must pay a $300.00 Interruption Fee.

Note: There is no control over which contestant pulls a Spenout Super Card. However, if a contestant pulls another contestant's category Spenout Super Card, that contestant must pay the category owner a $500.00 usage fee, or allow the owner to purchase the card for $200.00. (If contestant does not have $500.00 he is removed from the game). (As well, if owner of category does not have $200.00 to pay for card he is removed from the game. (At which time another contestant, counter clockwise, has an opportunity to buy the Super Card with the same stipulation).

When a player's initialed Stimulus Traveler stops on an Action slot, it is mandatory for the contestant to abide by what is labeled on the slot. (Action slots are mandatory). (Example: If a contestant stops on his or her sacrifice, a payment of $800.00 must be paid to the Spenout bank into the contestant's future account. This is mandatory savings for when unexpected expenses occur. The contestant cannot use this money).

When a contestant's Stimulus Traveler stops on an Action slot of a visitor, the contestant must pay 100 times the number on that slot. (Example: contestant stops on visitor's Home #7, he must pay owner $700.00 trespassing fee).

The Spenout game starts with each contestant receiving $10,000: $1,500 cash, $3,500 on debit card, $5,000 on credit card. Using credit card is a 20% mark-up instantly adding the 20% interest rate onto the purchased item.

There is a continuous debt accumulator which tallies how much each contestant spends. This accumulator is for the viewing audience and financial advisors to observe player's spending habits.

The first contestant who pushes the S-P-E-N-O-U-T button and believes he has accumulated the most and wisest debt, and cannot be challenged by another contestant with more debt, has an opportunity to go before the Financial Advisory Board for a chance to receive a financial payout.

In order for a contestant to receive an opportunity for a payout, he must pay a $100.00 Payout fee. If contestant does not have the fee, he looses the opportunity to go before the Financial Advisory Board and is removed from the game. The game continues with the five contestants.

If another player has accumulated more debt than the player who pushed the Payout button, is challenged by that contestant, and found to have more debt than the contestant who made the challenge, that contestant is taken out of the game. The game winning opportunity then goes to the individual who made the challenge.

Contestant has an opportunity to receive a payout after satisfactorily answering within 30 seconds a Change spending question from the Financial Advisory Board. (Contestant answers question during intermission).

Contestant must answer briefly, precisely and convincingly to the Financial Advisory Board spending changes he will make not to need another Payout.

If contestant cannot answer change questions satisfactorily to the Financial Advisory Board within the 30 second timeframe, the contestant becomes ineligible for a Payout and must file bankruptcy or chapter 7.

If contestant fails to answer change question in the allotted time frame, but can convince one person from the television audience s(he) deserves some type of Payout, contestant is eligible to receive an audience Payout or prize. The majority in the audience vote on what contestant should receive. (Prize will be $6.00-$600.00).

If contestant has accumulated a debt of $4,000 or more in wise spending there is an opportunity to receive no less than $4,000, and up to $40,000 Sponsor Main Street Spenout.

If contestant has accumulated a debt of $6,000 or more in wise spending, there is an opportunity to receive no less than $6,000 and up to $60,000 Advertiser National Spenout.

If contestant has accumulated a debt of $8,000 or more in wise spending, there is an opportunity to receive no less than $8,000 and up to $80,000 Business Network Spenout.

If contestant has accumulated a debt of $10,000 or more in wise spending, there is an opportunity to receive no less than $10,000 and up to $100,000.00 Super Network Spenout.

If contestant does not answer satisfactorily to the Financial Advisory Board within the allotted time frame, he becomes ineligible for a Payout and must file bankruptcy or chapter 7. The money or prize will be awarded to charity.

Spenout cash, in some instances, may be substituted for prizes at the discretion of network producers/sponsors and Spenout executives.

If a contestant has insufficient funds to play, he is eliminated from the game.

Thus, while the principles of the invention have been made clear in an illustrative embodiment, there will be immediately obvious to those skilled in the art many modifications of structure, arrangements, proportions, the elements, materials and components, used in the practice of the invention which are particularly adapted for specific environments and operating requirements without departing from those principles.

What is claimed is:

1. A computer-implemented method to play a game, comprising:

(i) providing, using a processor or microprocessor in a computer, a game apparatus, said game apparatus including:

a board or play area divided into six categories, each category having a plurality of category slots or spaces and a plurality of action slots or spaces, wherein each action slot in a category corresponds to a different subject matter with directions thereon requiring a particular action for a player landing on that action slot, with one action slot in each category comprising a home base action slot for that category;

a plurality of sets of opportunity cards, each set of opportunity cards corresponding to one category and comprising the same number of cards, wherein each card indicates an item or service offered and a corresponding price for said item or service, thereby presenting a player landing on a category slot of that category the option to purchase said item or service when that card is selected;

a plurality of player pieces, each player piece corresponding to one category;

a random number generator for determining player piece movement; and a spending capital component for each player, said spending capital component representing cash on hand, available debit, available credit, or some combination thereof;

(ii) distributing, using a processor or microprocessor in a computer, a predetermined amount of spending capital to each player;

(iii) generating, using said random number generator, a random number for each player in turn, whereby the players take turns moving their said player pieces around the spaces or slots on the board or play area in accordance with his or her random number, said player pieces landing upon said spaces or slots, and take actions or follow certain directions depending on the space or slot on which the player piece lands; wherein the directions on one or more of the action slots include making one or more mandatory payments and accruing debt;

(iv) continuing with step (iii) until a first player indicates that he or she has accumulated more debt than the competing players, and is ready to qualify to receive a financial payout or bailout;

(v) prompting said first player to answer a change question; and (vi) declaring the first player the winner of the game if the first player has accumulated the most debt and successfully answered the change question; otherwise removing the first player from the game and continuing with step (iii) until a subsequent player indicates that he or she is ready to proceed to step (iv).

2. The method of claim 1, wherein the cash on hand component comprises play money scrip.

3. The method of claim 1, wherein the available debit component comprises a play debit card.

4. The method of claim 1, wherein the available credit component comprises a play credit card.

5. The method of claim 1, further comprising the step of awarding a monetary prize to the player who wins the game.

6. The method of claim 1, wherein the game is presented as a television game show.

7. The method of claim 1, wherein the game is presented as a video game.

8. The method of claim 1, wherein the random number generator is a computer-based random number generator.

* * * * *